United States Patent [19]

Achelpohl

[11] 4,285,685

[45] Aug. 25, 1981

[54] APPARATUS FOR FORMING LOOPS IN TUBE SECTIONS FOR MAKING SACKS FOR THE PURPOSE OF COMPENSATING FOR DIFFERENT LENGTHS OF SECTIONS

[75] Inventor: Fritz Achelpohl, Lengerich, Fed. Rep. of Germany

[73] Assignee: Windmoller & Holscher, Lengerich, Fed. Rep. of Germany

[21] Appl. No.: 71,362

[22] Filed: Aug. 30, 1979

[30] Foreign Application Priority Data

Sep. 4, 1978 [DE] Fed. Rep. of Germany ..... 2838569

[51] Int. Cl.[3] ..... B31B 1/52

[52] U.S. Cl. ..... 493/406; 493/449; 493/450; 493/254

[58] Field of Search ..... 93/8 R, 13, 84 R, 35 R, 93/61 R, 62; 270/66, 69, 86; 156/583.5; 493/406, 449–450, 243, 250, 254

[56] References Cited

U.S. PATENT DOCUMENTS

| | | | |
|---|---|---|---|
| 2,205,127 | 6/1940 | Spiess | 270/69 |
| 3,190,049 | 6/1965 | Van der Meulen | 93/8 R X |
| 3,838,631 | 10/1974 | Simpson et al. | 93/8 R X |
| 3,918,698 | 11/1975 | Coast | 270/69 |
| 4,115,183 | 9/1978 | Achelpohl et al. | 156/583.5 X |

FOREIGN PATENT DOCUMENTS 1924109 3/1974 Fed. Rep. of Germany .

*Primary Examiner*—James F. Coan

*Attorney, Agent, or Firm*—Fleit & Jacobson

[57] ABSTRACT

Sections of bag-making material are successively and intermittently fed by double belt conveyors to arrive beneath a vertically reciprocatable push member which engages each section by suction and forms a central loop in each section while its ends are yieldingly engaged by brake shoes co-operating with side supports.

12 Claims, 1 Drawing Figure

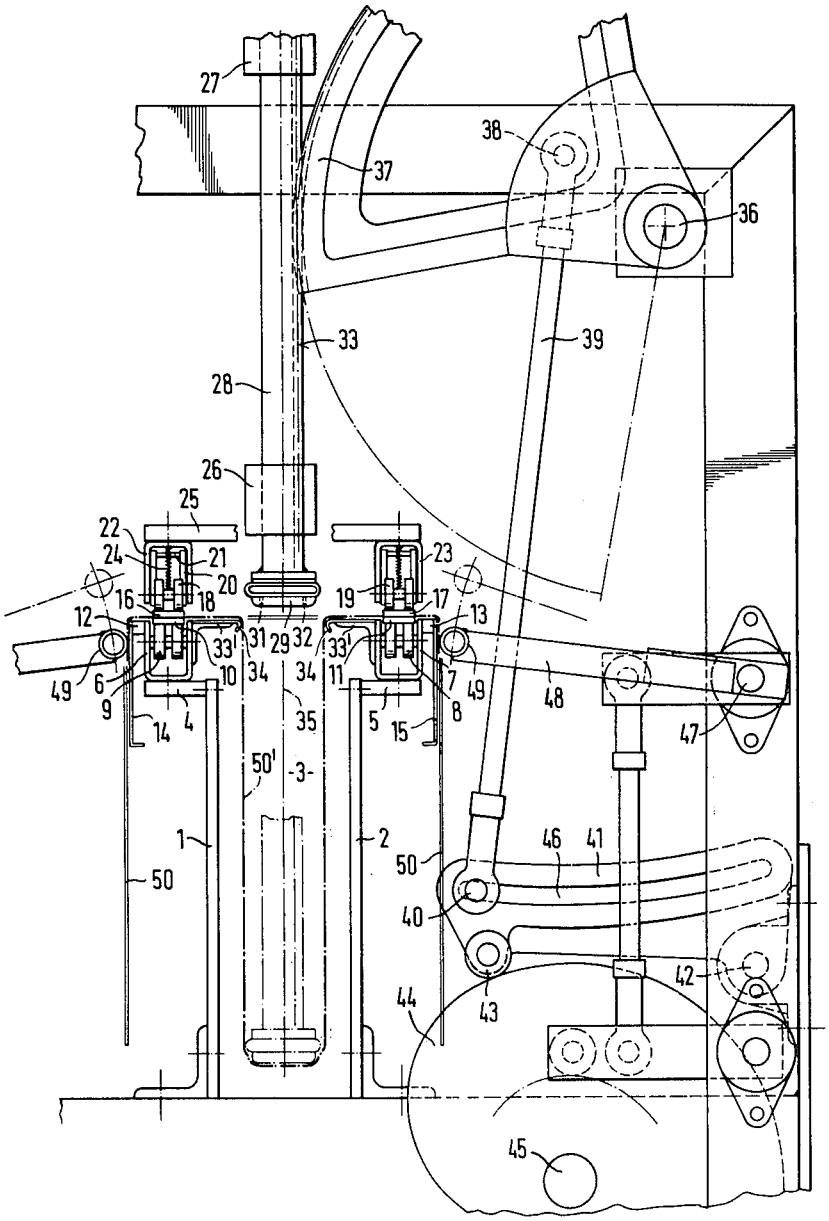
27
37
38
36
33
39
28
26
25
22
24
21
20
23
16
18
19
17
12
13
31
29
32
33'
33'
49
6
9
10
34
34
11
7
8
49
48
14
4
35
5
15
47
50'
-3-
1
2
46
41
50
50
40
42
44
43
45

APPARATUS FOR FORMING LOOPS IN TUBE SECTIONS FOR MAKING SACKS FOR THE PURPOSE OF COMPENSATING FOR DIFFERENT LENGTHS OF SECTIONS

The invention relates to an apparatus for forming loops in transversely fed tube sections for making sacks, comprising two parallel double belt conveyors clamping the tube sections at both sides of and equal spacings from their centre line.

Starting with flat-lying tubular webs of plastics film or single or multi-ply kraft paper, sacks are made by severing tube sections of predetermined length from the tubular webs and forming cross-bottoms at one or both ends thereof in that the ends of the tubes are pulled open to form corner folds onto which side flaps at right-angles to the corner folds are folded to overlap each other. To increase the strength of the bases, internal locks can be adhered or welded onto the pulled-open base squares and the bases, which have been closed by folding over the side flaps and cemented shut can be reinforced by adhesively applied base sheets. Modern mass production of cross-bottom sacks takes place in a manner such that tube sections of predetermined length are severed from an intermittently advanced tubular web of film and transferred to a conveyor which feeds the sections intermittently or continuously in a transverse position and moves them through the base-forming stations. The individual tube sections must be correctly positioned on this transversely conveying conveyor so that the folding tools for forming the base can form the bases without incorrect folding. Especially when bases are to be formed at both ends of a tube section, sacks of a predetermined same length can only be formed in one apparatus because the spacing of the base-forming stations disposed at both sides of the means for conveying the tube sections in a transverse position is governed by the length of the sections.

Sacks of different lengths can be made in one apparatus without requiring expensive reconstructions if the base-forming stations are spaced apart by a distance corresponding to the smallest height of sack and for the purpose of making longer sacks the central portion of the tube sections is laid into a loop and conveyed through the base-forming stations in loop form.

In an apparatus of the aforementioned kind known from DE-PS No. 19 24 109, the loops are formed in that the tube sections severed from a tubular web are guided in a transverse direction onto a central upwardly inclined tube so that the depending ends of the tube section can be engaged by grippers secured to the sides of conveyors. Only after the grippers have engaged the tube section will the loop be released from the tube so that it will be formed by sagging downwardly. Although the bases can be formed, independently of the length of the tube section, at the ends of the tube section projecting beyond the grippers, the known apparatus has the disadvantage that complicated and expensive guides are required which are not, however, capable of guiding the tube section so exactly that one can dispense with trimming the edges of the sack section with trimming knives to arrive at the desired size. Accordingly, it is not only necessary to provide additional trimming knives but the tube sections must be longer than necessary for making sacks of a predetermined height so as to take unavoidable displacements of the tube sections into account. The edges of the tube section severed by the trimming knives give rise to a loss of material which constitutes waste which also has to be removed.

It is therefore the object of the present invention to provide an apparatus of the aforementioned kind with which transversely conveyed tube sections of a length corresponding to the desired sack height can be laid into loops on the conveyor without the danger of distorting the ends of the tube sections that might detrimentally influence the precise formation of the bases.

According to the invention, a punch is provided which can be raised and lowered vertically in the medial plane between the double belt conveyors and has suckers at its underside. In the case of the apparatus according to the invention, the tube sections severed from the tubular web are taken over by the double belt conveyors centrally and are intermittently conveyed to the loop forming station in synchronism with the machine cycle. While each tube section is at a standstill, the punch is lowered centrally onto the tube section disposed thereunder and suction-attracted thereby symmetrically with respect to its transverse axis. The punch is then lowered into the gap between the belt conveyors, the belts of which are narrow, by an amount corresponding to the desired length of loop, the side portions of the tube section being pulled into the gap symmetrically with respect to the centre line because slipping of the tube section relatively to the punch is effectively prevented by the suckers. Depending on the particular length of tube section, the central portions of the tube sections are laid into a loop which is so large that the ends of the tube sections project beyond both sides of the conveyors by an amount necessary for forming the cross-bottoms. Since the tube sections are centrally located by the suckers on the punch forming the loops, alignment or trimming of the tube sections is not required after the loop formation.

To avoid the need for pulling the tube sections with excessive friction between the belt conveyors during loop formation, raisable pressure rollers may be provided for pressing the upper belts against the lower belts. For the purpose of loop formation, the upper belts can thereby be entirely or partially lifted off the lower belts.

To prevent the ends of the tube section that are pulled between the belt conveyors from executing uncontrolled movements, the outside of the belt conveyors may be provided with surfaces against which brake elements can be applied. These brake elements hold the ends of the tube sections back so that they cannot execute undesirable movements.

Desirably, the brake elements consist of tubes disposed at the ends of pivotable levers which can be applied along surface lines against the surfaces which consist of metal plates and form counterbearings.

Further advantageous embodiments of the invention have been described in the subsidiary claims.

One example of the invention will now be described with reference to the accompanying drawing of which the single FIGURE is a diagrammatic cross-section through the apparatus for forming loops in the tube sections.

Supporting members 4, 5 are screwed to the upper ends of vertical supports 1, 2 which are secured in the machine frame in parallel rows and define a shaft 3 between each other. U-shaped supports 6, 7 are secured on the supporting members 4, 5 and rollers 8, 9 are mounted between their limbs over which the lower belts 10, 11 of double belt conveyors pass parallel to each other.

Vertical supporting plates 14, 15 are secured to the outsides of the supports 6, 7 by way of spacers 12, 13. Horizontal guide plates 34 are secured to the confronting inner sides of the supports 6, 7 by way of angle irons 33' and their confronting edges are bent downwardly to form the upper rim of the shaft 3.

The upper belts 16, 17 of the double belt conveyors run over rollers 18, 19 mounted at the free ends of levers 20 which bifurcatingly surround the rollers, the other ends of the levers being pivotally mounted in the hinges 21 in the supports 22, 23. The levers 20 are longer than the height of the limbs of the U-shaped supports 22, 23 and extend obliquely therein so that the rollers 18, 19 can be swung out of the supports 22, 23. Between the levers and the supports or the bearing axis of the rollers 18, 19 and the supports there are compression springs 24 so that the rollers 18, 19 can be resiliently pushed into the supports 22, 23.

The supports 22, 23 are secured on a supporting member 25 with which they can be raised and lowered by a drive (not shown).

The upper and lower belts 10, 11 and 16, 17 run in known manner over driving and direction-changing drums as well as guide rollers (all not shown). For the purpose of length compensation of the upper belts 16, 17 while they are raised and lowered, rollers are provided through which the belts are passed in a loop of variable size.

Above the shaft 3 there is a raisable and lowerable punch 28 which is vertically displaceable in the fixed guides 26, 27 symmetrical to the longitudinal medial plane 35. The punch 28 is provided at its lower end with a sucker 29 which consists of elastomeric material and is provided with rows of suction holes 31, 32 symmetrical to the longitudinal medial plane 35. The punch 28 is shown in its raised position in full lines and in its lowered position in broken lines. A rack 33 secured on the punch 28 engages a gear segment 37 pivotable about a shaft 36 in the machine frame. The gear segment 37 is eccentrically connected to the coupling member 39 at the pivot 38, the other end of the coupling member being hinged to the lever 41 at the pivot 40. The lever 41 is pivotable about the fixed shaft 42. The free end of the lever 41 carries a cam roller 43 which runs on a cam plate 44 turning about the shaft 45. The cam plate 44 is driven in sequence with the machine cycle by a drive (not shown).

The lever 41 is provided with an arcuate elongate hole 46 having a radius of curvature corresponding to the length of the coupling member 39. To adjust the stroke of the gear segment 37, the pivot 40 is adjustable along the elongate hole 46.

Levers 48 pivotable about fixed shafts 47 carry tube members 49 at their free ends. The tube members can be applied against the supporting plates 14, 15. The levers 49 can be raised to the position shown in broken lines by means of drives (not shown).

By lowering the punch 28 from the position shown in full lines to that shown in broken lines, the tube section 50 can be pulled into the loop 50' after raising the upper belts 16, 17 and applying the tubes 49 against the supporting plates 14, 15. Following formation of the loop, the supply of suction air is interrupted and the punch 28 is returned to its elevated position. After lowering the pressure rollers 18, 19, the tube section 50' laid into a loop can then be conveyed in a correct position to the next following base forming stations.

The tube members 49 may also be connected to a vacuum source and be provided over their entire length with holes at the side facing the tube section 50 so that it is not necessary to apply the tube members 49 closely against the supporting plates 14, 15 and the tube section 50 will be held by suction effect.

I claim:

1. Apparatus for forming loops in transversely fed tube sections for making sacks, comprising two parallel double belt conveyors (10, 16; 11, 17) for clamping the tube sections at both sides at equal spacings from their centre line, a punch (28) vertically movable in the medial plane (35) between the double belt conveyors (10, 16; 11, 17), means for raising and lowering said punch, and suckers (29) positioned on the lower end portion of said punch for suction attracting tube sections.

2. Apparatus according to claim 1, characterised in that raisable pressure rollers (18, 19) are provided for pressing the upper belts (16, 17) against the lower belts (10, 11).

3. Apparatus according to claim 2, characterised in that the raisable pressure rollers (18, 19) are resiliently mounted.

4. Apparatus according to one of claims 1 to 3, further comprising generally vertical surfaces (14, 15) provided on the outside of the belt conveyors, and brake means for gripping portions of the tube section and having elements movable towards and away from said surfaces.

5. Apparatus according to claim 4, characterised in that the brake means comprise pivotable levers (48) and tubes (49) at the ends of the pivotable levers (48), said tubes being applied along surface lines against said surfaces which consist of metal plates (14, 15) and form counterbearings.

6. Apparatus according to one of claims 1 to 3, further comprising vertical guides (26, 27) for guiding movement of said punch, said means for raising and lowering comprising a rack (33) carried by said punch, and a gear segment (37) engaged with said rack for controlling the up and down motion of the punch (28).

7. Apparatus according to claim 6, characterised in that the gear segment (37) is pivoted about a rotary axis (36), and in that said means for raising and lowering comprises a rotary cam plate (44), and linkage means hinged to said gear segment (37) and moved by said cam plate (44) for controlling movement of said gear segment (37).

8. Apparatus according to claim 7, characterised in that the linkage means consists of a coupling member (39), a lever (41) hinged to said coupling member and pivoted to a frame of said apparatus, and the free end of the lever (41) is supported on the cam plate (44).

9. Apparatus according to claim 8, characterised in that a hinge point (40) of the coupling member (39) to the lever (41) is adjustable.

10. Apparatus according to claim 5, characterised in that the tubes (49) are in the form of suction tubes having suction holes at their sides facing the tube section (50).

11. Apparatus for forming loops in transversely fed tube sections for making sacks comprising:

means for conveying tube sections comprising two parallel double belt conveyors spaced apart from each other to define a gap therebetween, said belt conveyors clamping and defining a conveying plane for fed tube sections;

punch means positioned in the center of said gap for forming loops in the tube sections, said punch means comprising a punch having a lower end portion movable from a first position spaced above the conveying plane to a second position spaced below the conveying plane and sucker means carried by the lower end portion for suction attraction of the tube section during downward movement of the punch to form the loop; and means for controlling movement of said punch between said first and said second positions.

12. An apparatus according to claim 11, further comprising means for exerting a braking force on the tube sections to control movement thereof during formation of the loop.

* * * * *